US008600758B2

(12) United States Patent
Deshmukh et al.

(10) Patent No.: US 8,600,758 B2
(45) **Date of Patent: *Dec. 3, 2013**

(54) RECONSTRUCTION OF A SMOOTH SPEECH SIGNAL FROM A STUTTERED SPEECH SIGNAL

(75) Inventors: Om Dadaji Deshmukh, New Delhi (IN); Suraj Satishkumar Sheth, Guwahati (IN); Ashish Verma, New Delhi (IN)

(73) Assignee: Nuance Communications, Inc., Burlington, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/597,101

(22) Filed: Aug. 28, 2012

(65) Prior Publication Data

US 2012/0323570 A1 Dec. 20, 2012

Related U.S. Application Data

(63) Continuation of application No. 13/088,940, filed on Apr. 18, 2011.

(51) Int. Cl.
*G10L 21/06* (2013.01)

(52) U.S. Cl.
USPC ..... 704/271; 704/206; 704/272

(58) Field of Classification Search
USPC ..... 704/271, 272, 200, 220, 205–210, 201, 704/211; 400/208
See application file for complete search history.

(56) References Cited

U.S. PATENT DOCUMENTS 6,754,632 B1 * 6/2004 Kalinowski et al. ..... 704/271
2006/0193671 A1 * 8/2006 Yoshizawa et al. ..... 400/208

* cited by examiner

*Primary Examiner* — Huyen X. Vo
(74) *Attorney, Agent, or Firm* — Sunstein Kann Murphy & Timbers LLP

(57) ABSTRACT

Described herein are methods, systems, apparatuses and products for reconstruction of a smooth speech signal from a stuttered speech signal. One aspect provides for accessing a stored speech signal having stuttering; identifying at least one stuttered region in the stored speech signal; modifying the at least one stuttered region in the stored speech signal; and responsive to modifying the at least one stuttered region, reconstructing a smooth speech signal corresponding to the stored speech signal. Other embodiments are disclosed.

11 Claims, 5 Drawing Sheets

RECONSTRUCTION OF A SMOOTH SPEECH SIGNAL FROM A STUTTERED SPEECH SIGNAL

CROSS REFERENCE TO RELATED APPLICATION

This application is a continuation of U.S. patent application Ser. No. 13/088,940, entitled SYSTEMS AND METHODS FOR RECONSTRUCTION OF A SMOOTH SPEECH SIGNAL FROM A STUTTERED SPEECH SIGNAL, filed on Apr. 18, 2011, which is incorporated by reference in its entirety.

FIELD OF THE INVENTION

The subject matter presented herein generally relates to speech signal processing in the domain of stuttered speech.

BACKGROUND

Stuttering is a common speech disorder in which speech is not smoothly spoken as it contains repetition, prolongation/elongation (of words, phrases or parts of speech), inclusion of unnecessary or unusual silent gaps/breaths or delays, and the like. More than one of these stuttered regions might be found in a given utterance.

Speech signal processing includes for example obtaining, modifying, storing, transferring and/or outputting speech (utterances) using a signal processing apparatus, such as a computer and related peripheral devices (microphones, speakers, and the like). Some example applications for speech signal processing are synthesis, recognition and/or compression of speech, including modification and playback of speech.

BRIEF SUMMARY

One aspect provides a method comprising: accessing a stored speech signal having stuttering; identifying at least one stuttered region in the stored speech signal; modifying the at least one stuttered region in the stored speech signal; and responsive to modifying the at least one stuttered region, reconstructing a smooth speech signal corresponding to the stored speech signal.

The foregoing is a summary and thus may contain simplifications, generalizations, and omissions of detail; consequently, those skilled in the art will appreciate that the summary is illustrative only and is not intended to be in any way limiting.

For a better understanding of the embodiments, together with other and further features and advantages thereof, reference is made to the following description, taken in conjunction with the accompanying drawings. The scope of the invention will be pointed out in the appended claims.

DETAILED DESCRIPTION

Figure 1:
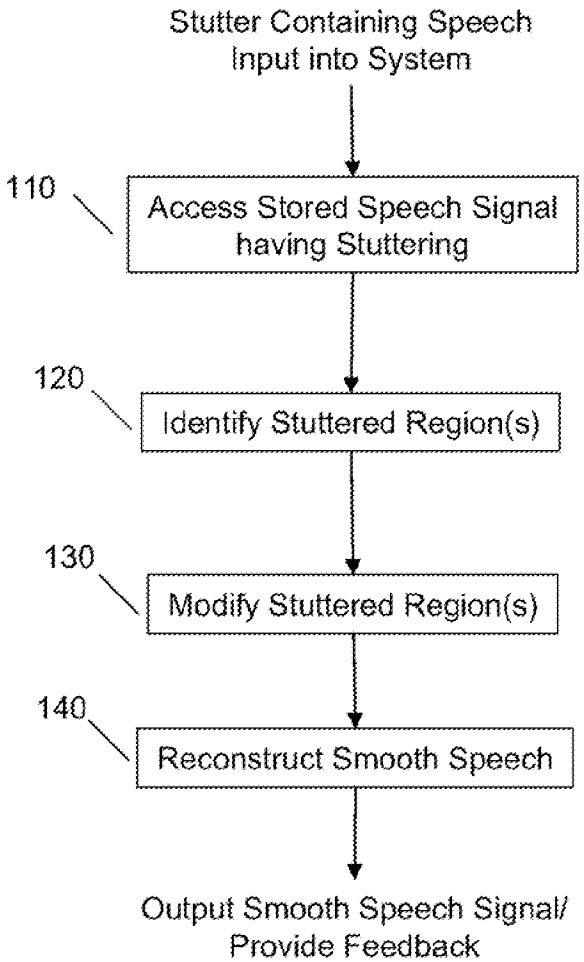
FIG. 1 illustrates an example of reconstructing a smooth speech signal given a speech signal containing stuttering.

It will be readily understood that the components of the embodiments, as generally described and illustrated in the figures herein, may be arranged and designed in a wide variety of different configurations in addition to the described example embodiments. Thus, the following more detailed description of the example embodiments, as represented in the figures, is not intended to limit the scope of the claims, but is merely representative of those embodiments.

Reference throughout this specification to "embodiment(s)" (or the like) means that a particular feature, structure, or characteristic described in connection with the embodiment is included in at least one embodiment. Thus, appearances of the phrases "according to embodiments" or "an embodiment" (or the like) in various places throughout this specification are not necessarily all referring to the same embodiment.

Furthermore, the described features, structures, or characteristics may be combined in any suitable manner in different embodiments. In the following description, numerous specific details are provided to give a thorough understanding of example embodiments. One skilled in the relevant art will recognize, however, that aspects can be practiced without certain specific details, or with other methods, components, materials, et cetera. In other instances, well-known structures, materials, or operations are not shown or described in detail to avoid obfuscation.

Stuttered speech presents significant challenges in the domain of speech processing. Stutter related work in the domain of signal processing has essentially consisted of (1) altering the speech signal by frequency alterations or time delay alterations over the entire duration of the speech signal, and rendering it back to the speaker through a special-purpose device fitted around the speaker's ear(s), or (2) providing visual feedback to the speaker to help him/her overcome a stutter, or (3) interactive procedures (for example, non-automatic) between subjects and a therapist to provide feedback to the subjects.

Accordingly, embodiments may be utilized in an effort to improve the spoken communication of persons with stuttered speech by applying signal processing to modify at least one stutter regions in the speech, and reconstruct a smooth speech signal, which can be used to provide feedback to a user. Thus, an embodiment is provided for automatically and directly converting a stuttered speech signal into its corresponding smooth speech signal version. For example, given a speech signal (potentially with stuttered regions), an embodiment automatically reconstructs a smooth version of the corresponding speech signal (that is, with no stutter) for feedback to a user. Additional feedback, for example in the form a speaker-specific stutter profile, may also be provided by various embodiments.

There are many possible implementations for the embodiments described herein. For example, many agencies focusing on speech therapy and/or disability services could utilize a cost-effective mechanism for stutter detection, stutter removal and stutter-related feedback. Thus, a computer program that takes stuttered speech as an input signal and replays the smooth version as output, and/or provides a speaker-specific profile regarding the type and amount of stuttering, would be of great value. As another example, a telecom provider may host such a service on their servers (such that, for example, the stuttered speech is spoken on one end of the call, is automatically processed to remove the stutters on the servers, and the smooth version is rendered at the received end of the call).

The description now turns to the figures. The illustrated example embodiments will be best understood by reference to the figures. The following description is intended only by way of example and simply illustrates certain example embodiments representative of the invention, as claimed.

To improve spoken communication of persons with stutter, embodiments provide an approach that modifies (for example, removes) the stuttered region(s) of the speech signal and restores the smooth regions in real-time. Such an approach may have the following subtasks: (1) identification of stutter locations/regions; (2) identification of stutter type (s); (3) design of appropriate remedial signal processing given the stutter types and their location(s); and (4) speech signal reconstruction.

The types of stutters are many, but may include at least repetition (for example, of syllables or parts of speech), prolongation/elongation (for example, of syllables or parts of speech), and inclusion of unnecessary or unusual silent gaps/breaths or delays and the like. Prolongation/elongation includes for example prolonging/elongating a part of speech (such as "llllost" (prolonging the "l" (phone) sound in "long")). Unnecessary or unusual silent gaps/breaths or delays may include examples such as "I am . . . (silence/breath) . . . here". Repetition includes for example repeating a part of speech such as "g,g,g,gone", repeating the "g" syllable in "gone".

An embodiment identifies the stuttered regions in a speech signal, including phone prolongation/elongation, inclusion of unnecessary or unusual silence/breath regions, and repetitions of syllables. An embodiment may operate on the speech signal directly; that is, it does not employ automatic speech recognition, which allows for language and domain independence capabilities.

Referring to FIG. 1, given an input utterance containing stuttered region(s) into a speech signal processing apparatus, an embodiment accesses the speech signal having stuttering 110. An embodiment then analyzes the speech signal statically 120 to identify stuttered region(s) within the speech signal. An embodiment then modifies the stuttered region(s) 130, which may include removing repeated syllables, shortening prolonged/elongated phones, removal of silence/breath regions, and/or removal of repeated phrases. Then, an embodiment reconstructs a smooth speech signal (that is, without the stuttered region(s) or with modified stuttered region(s)) 140. At this point, an embodiment may provide feedback via outputting (playing) the smooth speech signal and/or providing other feedback to the user, for example in the form of a speaker-specific profile.

Figure 2A:
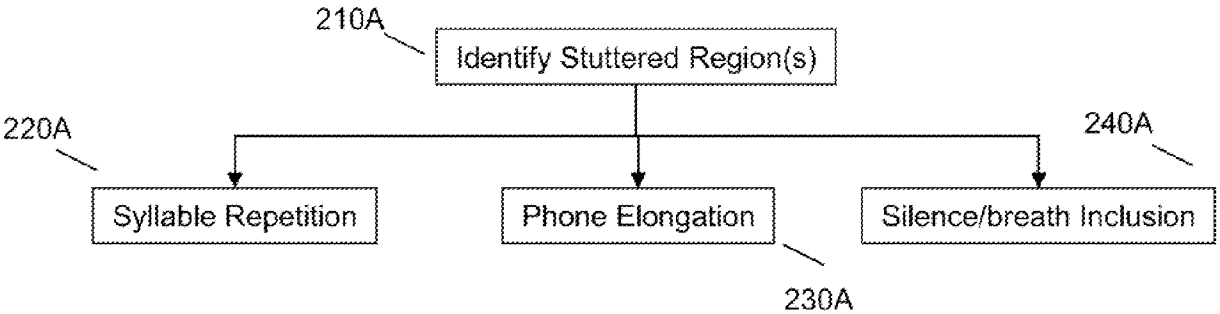
FIG. 2A illustrates examples of stuttered regions.

Referring to FIG. 2A, stutter detection includes detecting syllable repetition 220A, detecting phone prolongation/elongation(s) 220B, such as for example via identifying standalone fricatives, filled-pauses and voice-bars, as well as detecting unusual silence/breath regions in the speech signal 240A.

Figure 2B:
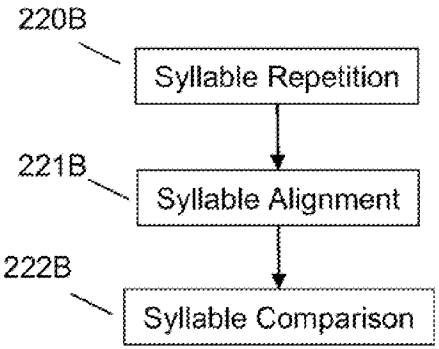
FIG. 2B illustrates an example of detecting syllable repetition.

Referring to FIG. 2B, syllable repetition 220B detection may be performed as a two-step process: syllable alignment 221B, and syllable comparison 222B. For syllable alignment 221B, an embodiment utilizes (a) computation of relative energy minima, (b) computation of a ratio of energy minima and adjacent maxima, and (c) detection of silence between two consecutive energy minima in a given speech signal, or a suitable combination of the foregoing, to accurately determine syllable boundaries and identify repeated syllables.

Once syllables are properly aligned, for syllable comparison, an embodiment may use standard frame-level features and conventional techniques (for example Mel-frequency cepstral coefficients (MFCCs) and Dynamic Time Warping (DTW)). An embodiment may also employ syllable-level features that capture dynamic variation of periodicity, frequency content and/or energy over the syllable duration (over N frames), as:

$$S_F=[1, 2, 3, \ldots, N][F_1, F_2 \ldots F_N]^T/(N*(N+1))$$

The above dot-product based syllable feature $S_F$ captures variations in the feature Foyer the N frames. The denominator normalizes for a variable number of frames N across syllables.

Referring back to FIG. 2A, previous efforts in formant-based vowel elongation detection may be used to detect elongation 230A of vocalic sounds (that is, sounds with clear formant structure may be identified based on areas within the speech signal having relatively steady formants (energy beats/steady frequency in speech signal)). Detection of elongation of phones without the formant structures (for example, fricatives, voice-bars, et cetera) may rely on spectral stability and typical characteristics of these phones, including their average duration in normal speech (predetermined). For example, for a speech signal varying less than expected over a given time (predetermined threshold), it may be identified as an elongated phone.

Referring to FIG. 2A, detection of silence/breath detection 240A may be accomplished in a number of ways. For example, after calculating energy minima in the speech signal, regions of the speech signal having lower energy may be identified as silent/breath regions. If these silence/breath regions (denoted by lower energy in the speech signal as compared with spoken parts of the speech signal) exceed a predetermined threshold, they may be identified as containing silence/breath and labeled as stuttered regions of this type.

Figure 3A:
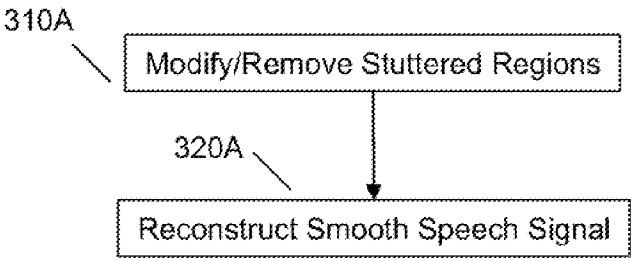
FIG. 3A illustrates an example of removing stuttered regions and reconstructing a smooth speech signal.
Figure 3B:
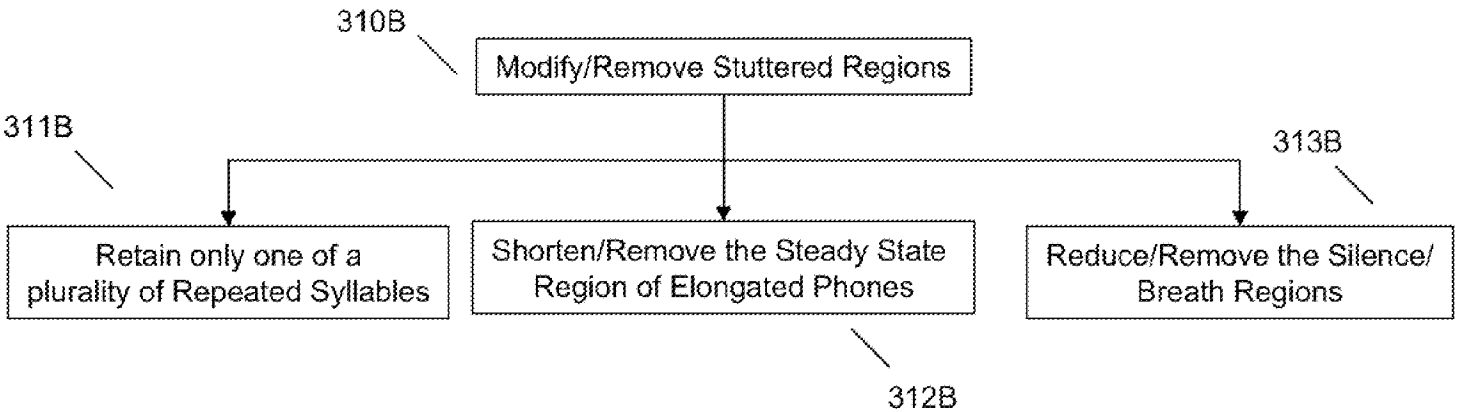
FIG. 3B illustrates example modifications to stuttered regions of a speech signal.

Referring to FIG. 3(A-B), an embodiment processes the input speech signal once the above analysis has been conducted to modify/remove stuttered regions 310A and reconstruct a smooth speech signal 320A, for example via using a technique such as pitch synchronous overlap and add (PSOLA). In modifying/removing stuttered regions 310B, an embodiment may retain one of the repeated syllables detected 311B, shorten/remove the steady state region of elongated phones 312B, and/or reduce/remove the silence/breath regions 313B, as appropriate.

Thus, an embodiment provides for modification of stuttered regions in the speech signal. For example, removal of stutter regions may be accomplished by retaining only one of all the consecutive repeated syllables, shortening the steady state region of elongated phones, and/or reducing the silence/breath regions in the speech signal. For smooth speech reconstruction, an embodiment may employ pitch synchronous overlap and add (PSOLA), or similar techniques, to reconstruct a smooth speech signal after the stutter region(s) are removed, as mentioned above.

Figure 4:
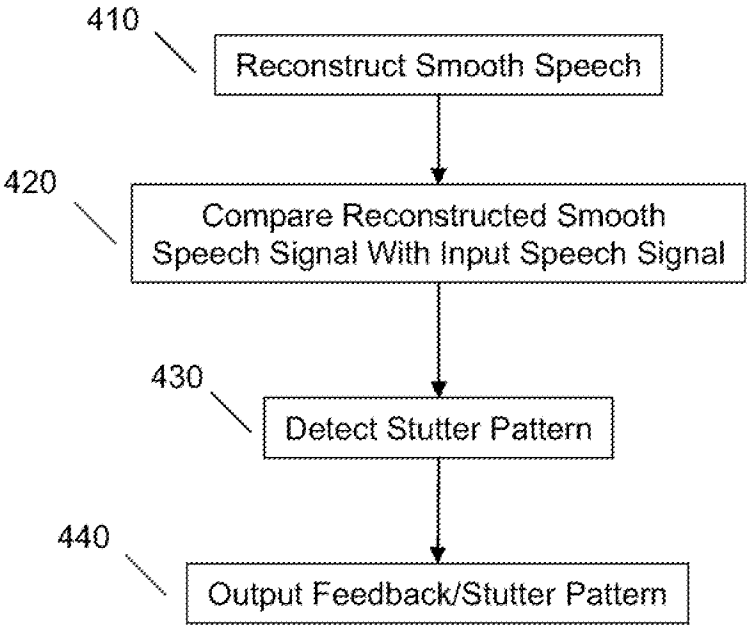
FIG. 4 illustrates an example of providing feedback to a user given a reconstructed speech signal.

Referring to FIG. 4, once the stuttered regions are identified, they may be labeled (for example with a stutter type such as repeated syllable, inclusion of silence/breath, phone elongation, and the like) and a pattern identified. This allows for a speaker-specific profile to be developed and provided as feedback to a user. For example, a given speaker may include one type of stutter more frequently than another. As a non-limiting example, an embodiment reconstructs the smooth speech signal 410 and compares that smooth speech signal with the input signal having stuttered region(s) 420. From the difference(s), a stutter pattern can be detected 430 and provided as feedback 440 in a variety of formats (for example, visual display, an audio playback, or mixture of visual display and audio playback of stutter types, including examples taken from the input and/or smoothed speech signal).

Thus, using the previous analyses an embodiment can compute the relative number and frequency of each type of stutter for every speech utterance. This information can help in providing appropriate feedback to the speaker in terms of his/her stutter pattern and ways to reduce stutter. Thus, an utterance may contain a pattern of particular types of stutters, at a particular frequency, and this speaker-specific feedback may be provided to the speaker to aid in speech therapy. The feedback may be provided in a number of ways. For example, a user profile may be generated with a score (such as indicating the frequency and type of stutter detected in the utterance), designation of stutter types contained in the utterance, and the like.

Figure 5:
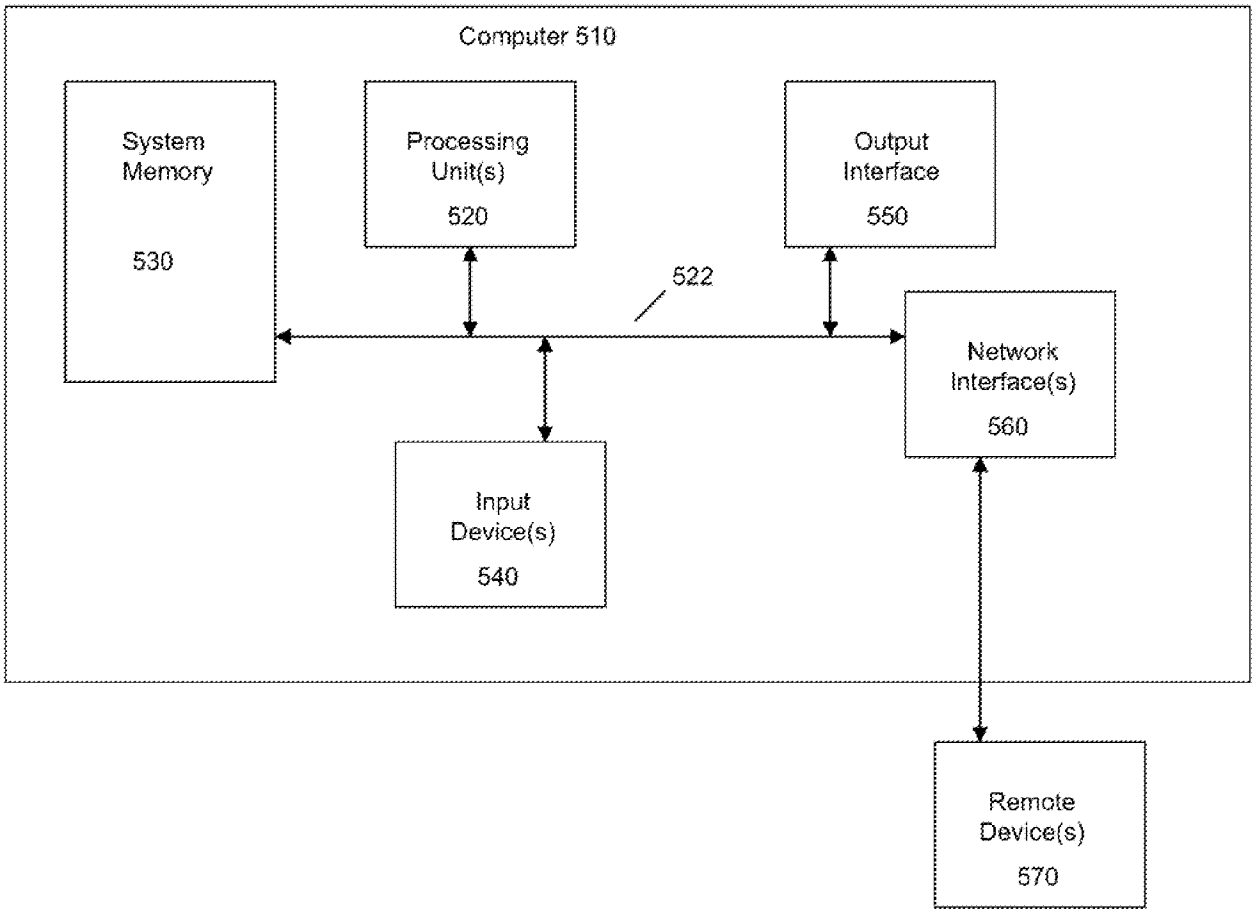
FIG. 5 illustrates an example computer system.

Referring to FIG. 5, it will be readily understood that certain embodiments can be implemented using any of a wide variety of devices or combinations of devices. An example device that may be used in implementing embodiments includes a computing device in the form of a computer 510. In this regard, the computer 510 may execute program instructions configured to reconstruct a smooth speech signal from a stuttered speech signal, and perform other functionality of the embodiments, as described herein.

Components of computer 510 may include, but are not limited to, at least one processing unit 520, a system memory 530, and a system bus 522 that couples various system components including the system memory 530 to the processing unit(s) 520. The computer 510 may include or have access to a variety of computer readable media. The system memory 530 may include computer readable storage media in the form of volatile and/or nonvolatile memory such as read only memory (ROM) and/or random access memory (RAM). By way of example, and not limitation, system memory 530 may also include an operating system, application programs, other program modules, and program data.

A user can interface with (for example, enter commands and information) the computer 510 through input devices 540, such as a microphone. A monitor or other type of device can also be connected to the system bus 522 via an interface, such as an output interface 550. In addition to a monitor, computers may also include other peripheral output devices, such as speakers for providing playback of audio signals. The computer 510 may operate in a networked or distributed environment using logical connections (network interface 560) to other remote computers or databases (remote device (s) 570). The logical connections may include a network, such local area network (LAN) or a wide area network (WAN), but may also include other networks/buses.

It should be noted as well that certain embodiments may be implemented as a system, method or computer program product. Accordingly, aspects may take the form of an entirely hardware embodiment, an entirely software embodiment (including firmware, resident software, micro-code, et cetera) or an embodiment combining software and hardware aspects that may all generally be referred to herein as a "circuit," "module" or "system." Furthermore, aspects may take the form of a computer program product embodied in computer readable medium(s) having computer readable program code embodied therewith.

Any combination of computer readable medium(s) may be utilized. The computer readable medium may be a non-signal computer readable medium, referred to herein as a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having at least one wire, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing.

Program code embodied on a computer readable medium may be transmitted using any appropriate medium, including but not limited to wireless, wireline, optical fiber cable, RF, et cetera, or any suitable combination of the foregoing.

Computer program code for carrying out operations for various aspects may be written in any programming language or combinations thereof, including an object oriented programming language such as Java™, Smalltalk, C++ or the like and conventional procedural programming languages, such as the "C" programming language or similar programming languages. The program code may execute entirely on a single computer (device), partly on a single computer, as a stand-alone software package, partly on single computer and partly on a remote computer or entirely on a remote computer or server. In the latter scenario, the remote computer may be connected to another computer through any type of network, including a local area network (LAN) or a wide area network (WAN), or the connection may be made for example through the Internet using an Internet Service Provider.

Aspects have been described herein with reference to flowchart illustrations and/or block diagrams of methods, apparatuses, systems and computer program products according to example embodiments. It will be understood that the blocks of the flowchart illustrations and/or block diagrams, and combinations of blocks in the flowchart illustrations and/or block diagrams, can be implemented by computer program instructions. These computer program instructions may be provided to a processor of a computer or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer, or other programmable apparatus, provide processes for implementing the functions/acts specified in the flowchart and/or block diagram block or blocks.

This disclosure has been presented for purposes of illustration and description but is not intended to be exhaustive or limiting. Many modifications and variations will be apparent to those of ordinary skill in the art. The example embodiments were chosen and described in order to explain principles and practical application, and to enable others of ordinary skill in the art to understand the disclosure for various embodiments with various modifications as are suited to the particular use contemplated.

Although illustrated example embodiments have been described herein with reference to the accompanying drawings, it is to be understood that embodiments are not limited to those precise example embodiments, and that various other changes and modifications may be affected therein by one skilled in the art without departing from the scope or spirit of the disclosure.

What is claimed is:

1. A method comprising:

accessing a stored speech signal having stuttering;

identifying at least one stuttered region in the stored speech signal;

modifying the at least one stuttered region in the stored speech signal, the modifying including at least one of:

a) retaining one of a plurality of repeated syllables in the stuttered region in the stored speech signal, b) shortening a steady state of elongated phones in the stuttered region in the stored speech signal, and c) reducing at least one silence/breath region in the stuttered region in the stored speech signal and responsive to modifying the at least one stuttered region, reconstructing a smooth speech signal corresponding to the stored speech signal.

2. The method of claim 1, further comprising comparing the stored speech signal with the smooth speech signal to detect at least one speaker-specific stutter pattern.

3. The method of claim 2, further comprising providing feedback related to the at least one speaker-specific stutter pattern as a speaker-specific profile.

4. The method of claim 3, further comprising: automatically detecting the at least one stuttered region; and automatically labeling the at least one stuttered region with at least one stutter type.

5. The method of claim 4, wherein reconstructing a smooth speech signal corresponding to the stored speech signal further comprises applying remedial signal processing based on at least one of location of the at least one stuttered region and a stutter type.

6. The method of claim 4, wherein the at least one stutter type is at least one of syllable repetition, phone elongation and silence/breath.

7. The method of claim 6, further comprising detecting syllable repetition via: aligning syllables; and comparing aligned syllables to detect repeated syllables.

8. The method of claim 7, wherein aligning syllables comprises: detecting relative energy minima in the stored speech signal; computing a ratio of energy minima and adjacent maxima in the stored speech signal; and detecting silence between two consecutive energy minima in the stored speech signal.

9. The method of claim 7, wherein comparing aligned syllables further comprises comparing at least two adjacent syllables using frame level features based on distance computation metrics.

10. The method of claim 7, wherein comparing aligned syllables further comprises comparing at least two adjacent syllables using syllable level features capturing dynamic variations over syllable duration in at least one of periodicity, frequency content, and energy.

11. The method of claim 6, further comprising detecting phone elongation via detecting at least one of fricatives exceeding a predetermined threshold, voice-bars exceeding a predetermined threshold, and vocalic sounds exceeding a predetermined threshold; wherein elongated phones include phones with or without a formant structure.

* * * * *